United States Patent [19]

Drobish

[11] Patent Number: 4,640,442

[45] Date of Patent: Feb. 3, 1987

[54] DISPENSING PACKAGE AND FOLLOWER DEIVCE

[75] Inventor: James L. Drobish, Wyoming, Ohio

[73] Assignee: The Procter & Gamble Company, Cincinnati, Ohio

[21] Appl. No.: 759,390

[22] Filed: Jul. 26, 1985

Related U.S. Application Data

[63] Continuation-in-part of Ser. No. 546,344, Oct. 31, 1983, abandoned.

[51] Int. Cl.[4] ..... B65D 37/00; B67D 5/42

[52] U.S. Cl. ..... 222/209; 222/213; 222/386.5; 220/93

[58] Field of Search ..... 222/212, 213, 256, 257, 222/259, 260, 386, 386.5, 389, 252, 391, 209; 92/34, 35, 37, 42; 220/85 B, 93

[56] References Cited

U.S. PATENT DOCUMENTS

| | | | |
|---|---|---|---|
| Re. 31,408 | 10/1983 | Czech et al. | 222/341 |
| 673,236 | 4/1901 | Brewington | 215/316 |
| 889,499 | 6/1908 | Anderson | 215/270 |
| 1,199,765 | 10/1916 | Cook | 215/363 |
| 1,804,627 | 5/1931 | Lukenbill | 215/363 |
| 1,939,569 | 12/1933 | Pfister | 215/53 |
| 1,961,554 | 6/1934 | Dodge | 206/56 |
| 2,098,408 | 11/1937 | Watson | 221/47.3 |
| 2,577,780 | 12/1951 | Lockhart | 128/220 |
| 2,606,529 | 8/1952 | Wagner | 120/42.4 |
| 2,669,370 | 2/1954 | Royall, Jr. | 215/47 |
| 2,902,190 | 9/1959 | Hosler | 222/386.5 |
| 2,954,890 | 10/1960 | del Valle | 215/52 |
| 3,088,636 | 5/1963 | Spatz | 222/213 |
| 3,184,120 | 5/1965 | Undi | 222/209 |
| 3,217,936 | 11/1965 | Abplanalp | 222/136 |
| 3,315,847 | 4/1967 | Trumbull | 222/327 |
| 3,338,447 | 8/1967 | Meyers, Jr. | 215/52 |
| 3,361,305 | 1/1968 | Spatz | 222/207 |
| 3,381,863 | 5/1968 | Towns | 222/386.5 |
| 3,721,371 | 3/1973 | Dolveck | 222/386.5 |
| 3,766,918 | 10/1973 | Kessel | 128/218 P |
| 3,768,705 | 10/1973 | Spatz | 222/213 |
| 3,828,988 | 8/1974 | Berry | 222/389 |
| 3,854,826 | 12/1974 | Adams | 401/188 |
| 3,915,352 | 10/1975 | Scheindel | 222/389 |
| 4,108,219 | 8/1978 | Shulsinger | 141/3 |
| 4,109,833 | 8/1978 | Gross | 222/386.5 |
| 4,154,371 | 5/1979 | Kolaczinski | 222/212 |
| 4,169,547 | 10/1979 | Newell | 222/386 |
| 4,213,545 | 7/1980 | Thompson et al. | 222/386.5 |
| 4,402,431 | 9/1983 | Wiegner et al. | 222/207 |
| 4,413,759 | 11/1983 | Mettenbrink | 222/213 |
| 4,474,313 | 10/1984 | Sieverding | 222/386 |
| 4,533,069 | 8/1985 | Drobish | 222/386.5 X |

FOREIGN PATENT DOCUMENTS

| | | |
|---|---|---|
| 2920915 | 11/1980 | Fed. Rep. of Germany . |
| 875780 | 10/1942 | France . |
| 197618 | 1/1965 | Sweden . |

*Primary Examiner*—Joseph J. Rolla
*Assistant Examiner*—Jay I. Alexander
*Attorney, Agent, or Firm*—R. C. Witte; J. V. Gorman

[57] ABSTRACT

A dispenser for a product is described which incorporates a follower piston slidably mounted therewithin. The dispenser comprises an axially extending bore of a tubular container body for housing a product to be dispensed and having an upper end from which the product is dispensed and an open lower end. The follower piston is slidably mounted within the lower end of the bore of the container body to support the product thereabove. The piston is constructed of resilient material and comprises a face portion adapted to contact the product and a peripherally attached sidewall. The sidewall further comprises at least one integral peripheral contact band conforming to the shape of the cross section of the bore, and is adapted to virtually resiliently extend or contract in response to axial forces exerted on the face portion with such change in length resulting in an inversely proportional virtual change in lateral dimension of the peripheral contact band. The peripheral contact band is dimensioned to provide an interference fit within the bore which exerts a predetermined normal force against the inner surfaces of the bore in static condition.

33 Claims, 14 Drawing Figures

DISPENSING PACKAGE AND FOLLOWER DEIVCE

CROSS-REFERENCE TO RELATED APPLICATION

This is a continuation-in-part of the prior copending application entitled "Follower Device For Dispensing Package", Ser. No. 546,344, filed Oct. 31, 1983, now abandoned, in the name of James L. Drobish.

TECHNICAL FIELD

This invention relates to a dispensing package for a product, and, more particularly, to a dispensing package which includes a follower piston slidably mounted within the package designed to establish a minimum predetermined amount of frictional resistance to axial displacement within the package, and more easily moved upwardly than downwardly by axial forces therein.

BACKGROUND ART

Much work has been directed to dispensing packages for liquids and other fluent masses. Swedish Pat. No. 197,618, which issued to K. H. Lundberg on Jan. 21, 1965, from an application filed June 21, 1961, for example, discloses a receptacle for paste-like or liquid material comprising a transparent tube equipped on one end with a tapering flexible hollow head having a slit opening therethrough. In one version of the receptacle described by Lundberg, the transparent tube is equipped with a plunger provided with a number of ring-shaped flanges extending obliquely from the plunger in a backward direction relative to the hollow head. In use, a portion of the hollow head is manually squeezed together thereby reducing the volume within the head and discharging material through the slit. Upon release of the squeezing force, the slit closes as the hollow head returns to its original volume, thus creating a slight underpressure within the receptacle and thereby moving the plunger in a direction toward the hollow head.

A container adapted to hold semi-solid or fluent masses and embodying dispensing features for controlling the discharge of such masses is disclosed in U.S. Pat. No. 3,088,636, which issued to Walter B. Spatz on May 7, 1963. The Spatz U.S. Pat. No. 3,088,636 dispenser describes a container having a pliant plastic head capable of decreasing the effective volume within the container, a self-closing discharge opening, and a one-way follower device. Inward deflection of the pliant head decreases the volume within the dispenser and effects an opening of the discharge outlet, thus allowing the fluent material to pass therethrough. A one-way latch mechanism is attached to the central rear portion of the follower and includes a plurality of circumferentially spaced latch fingers which extend laterally in an outward and rearward direction and function to engage the inner wall of the container to prevent rearward motion of the follower device within the container. Upon release of the pressure on the head, the lips of the discharge outlet are closed and the head resiliently returns to its original configuration, thus creating a partial vacuum within the container and allowing atmospheric pressure to act on the one-way follower device pressing it forwardly within the container.

U.S. Pat. No. 3,768,705, which issued to Walter B. Spatz on Oct. 30, 1973, is also directed to a dispenser for fluent mass and shows a one-way follower slidingly mounted within a pliant elastic container behind the fluent material contained therein. A butterfly check-valve is disposed in the outlet of the elastic container and opens to allow dispensing in response to squeezing of the container at any point. Subsequent to the removal of a squeezing force on the elastic container, the outlet check-valve closes, thus preventing air from entering the container as the pliant container walls return to their original position, thereby creating a negative pressure within the container. The follower comprises a one-way latch device similar to that described in the Spatz U.S. Pat. No. 3,088,636 having rearwardly disposed latch fingers which prevent movement of the follower in the rearward direction. As in Spatz U.S. Pat. No. 3,088,636 ambient air at atmospheric pressure moves the follower forwardly within the container as the result of the vacuum created after a dispensing operation.

A pump-action dispensing package for liquids and paste-like products is taught in U.S. Pat. 4,301,948, which issued to Joachim Czech and Hans Sieghart on Nov. 24, 1981, and which was reissued as U.S. Pat. No. Re 31,408 on Oct. 11, 1983. This dispenser features a container closed at its lower end by a slidable piston and provided at its upper end with a head member which includes a variable-volume pump chamber. The pump chamber itself is isolated from the bulk of the product in the container by a first check valve adapted to open only towards the pump chamber, and is isolated from an extended outlet passage by a second check valve adapted to open only towards the outlet. Exterior manual pressure exerted on the pump head piston decreases the volume in the pump chamber and forces product through the second check valve and outlet, thereby dispensing a portion of the product. Upon removal of said force, the pump chamber returns to its original volume thereby creating a partial vacuum within the pump chamber and causing the second check valve to close and the first check valve to open, thus permitting product from the container to enter the pump chamber and replace the mass of product which had been dispensed.

Despite all of the prior work done in this area, as evidenced by the above-cited patents, there remain problems of complexity of the dispensers, assembly of the parts, reliability of function, and excessive cost. The packages of the prior art require complex valving structures, and/or multi-part follower devices, and/or correspondingly complex assembly operations, and still are not always reliable in operation. Such shortcomings result in dispensers which are messy, inconvenient, and expensive.

DISCLOSURE OF THE INVENTION

It is an object of the invention to obviate the above-described problems.

It is an object of the present invention to provide an economical and reliable dispensing package requiring a minimum of parts and assembly operations.

It is another object of the present invention to provide a manually operated elevator-type piston for products including solids (i.e stick or cream dispensers).

It is also an object of the present invention to provide an improved dispensing package with a one-piece integrally formed follower piston which can be functionally designed in relation to the other parts of said package to optimize the functional characteristics and convenience thereof.

It is still another object of the present invention to provide a pump dispensing package which features added convenience without added cost in relation to other conventionally known dispensing packages.

In accordance with one aspect of the present invention, there is provided a dispenser for a product, wherein the product is housed in an axially extending bore of a tubular container body having an upper end from which the product is dispensed and an open lower end. The dispenser includes a follower piston slidably mounted within the lower end of the tubular container body to retain the product within. The follower piston comprises a face portion adapted to contact the product within the container body, and a depending sidewall which is formed with at least one integral peripheral contact band conforming to the shape of the cross section of the bore. The sidewall is adapted to virtually resiliently longitudinally extend or contract in response to axial forces exerted on the face portion with such change in length resulting in an inversely proportional virtual change in lateral dimension of the peripheral contact band. The follower piston is hollow with the interior surfaces of its face and sidewall exposed to atmospheric pressure, and the contact band of the follower piston is dimensioned to provide an interference fit within the bore of the container body which exerts a predetermined normal force against the sidewalls of the bore when the follower piston is in static condition.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
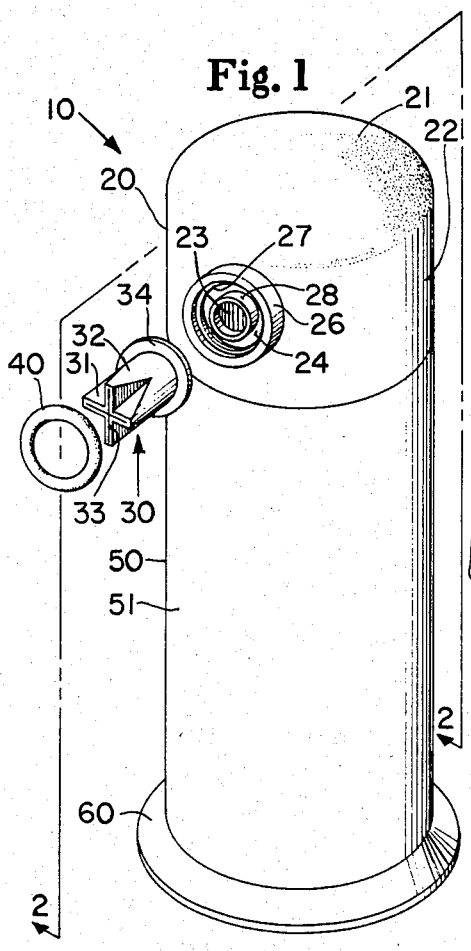
FIG. 1 is a partially exploded perspective view of a preferred embodiment of a dispenser incorporating the follower device of the present invention.
Figure 2:
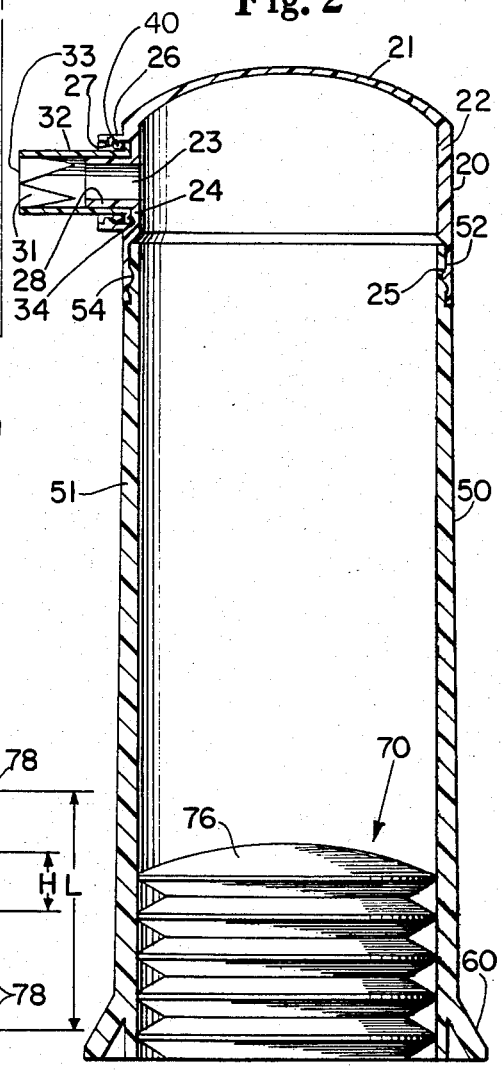
FIG. 2 is a vertical cross-sectional view of the dispenser of FIG. 1 taken along line 2—2 of FIG. 1.
Figure 3:
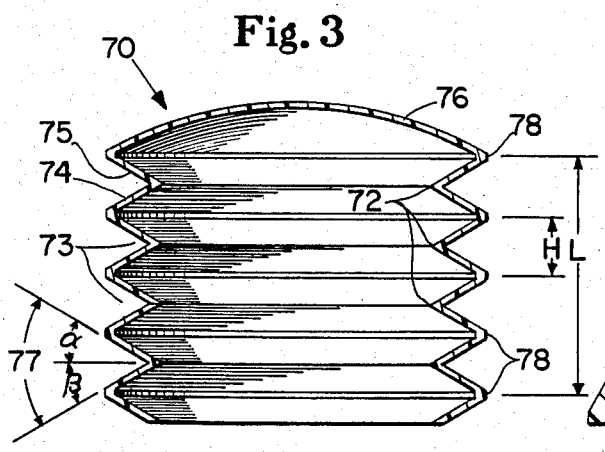
FIG. 3 is an enlarged vertical cross-sectional view of the dispenser follower piston of FIG. 2.

Referring now to the drawings, wherein like numerals indicate the same elements throughout the views, FIGS. 1 through 3 illustrate in detail a pump-type package 10 which includes a container body 50, a self-sealing dispensing nozzle 30, a resilient top 20, and a follower piston 70. The product, not shown, to be dispensed fills the package 10 interior, and can generally be any flowable substance or liquid.

The container body 50 is constructed of any substantially rigid material (such as metal, paperboard, plastic, or composite structures combining two or more of these materials) and comprises a tubular portion 51 open at both ends with an upper recessed exterior portion 52 having a snap-fitment groove 54 formed therein. The tubular portion 51 preferably has a circular axial bore therethrough, but the inner cross section of such bore can be of any desired shape (such as square, rectangular, or oval). A circular bore is preferred, however, because it is difficult to establish a seal around a piston having a different configuration.

While absolute rigidity of tubular portion 51 is not essential, substantial rigidity is preferred because the volume of fluid product dispensed from the package will be affected during any particular dispensing operation by changes of volume permitted by non-rigid structures and, moreover, rigidity helps insure substantially parallel inner wall surfaces for proper sealing with the follower piston 70, which will be discussed in greater detail below. Plastic (e.g., polypropylene, polyacrylonitrile, or polyethylene terephthalate) is a preferred material for tubular portion 51 as it provides expediency and ease in the manufacturing process.

Formed about the bottom outer periphery of container body 50 is an integral base 60 extending downwardly and outwardly from the outer surfaces of tubular portion 51, the lower distal surfaces of which are coplanar with and outwardly spaced from the lowermost end of tubular portion 51.

Resilient top 20 is preferably constructed of a resilient material (e.g. polypropylene, polyethylene terephthalate, polyacrylonitrile, elastomers, or polymer composites), and has a rounded top section 21 with a smooth outer finish. Rounded top section 21 is preferably formed with a thickness in the range of approximately 0.43–0.51 mm (0.17–0.020 inches) and with a radius of curvature of approximately 50 mm (2.0 inches) when used with a container body 50 having an outside diameter of approximately 41.3 mm (1.625 inches). Actual thicknesses may vary widely, however, depending on factors such as materials used, container diameter, etc. Depending from the outer periphery of top section 21 is skirt 22 having a snap-fitment rib 25 formed about its lower inner periphery. The depending skirt 22 and its snap-fitment rib 25 are sized so as to permit the resilient top 20 to be snapped into locking relation with the recessed portion 52 and its snap-fitment groove 54. As will be seen, the seal along the connection of resilient top 20 and container body 50 should be substantially fluid-tight at the dispenser operating pressures for proper operation of the subject dispensing package. The described snap/lock connection arrangement is shown only as an example, as the container body 50 and resilient top 20 can be molded as one piece, obviating the need for such a seal, or attached by a plethora of alternative methods such as by threads, spin-welding or adhesives.

A dispensing passageway 23 is formed through the depending skirt 22 and extends radially outwardly through the interior of tubular protuberance 28. Circumscribing and radially spaced from the outer surfaces of protuberance 28 is an outwardly extending circumscribing retaining wall 26. Both the protuberance 28 and the circumscribing retaining wall 26 are concentrically aligned about a common central axis which is substantially perpendicular to the central axis of container body 50. Tubular protuberance 28 and the circumscribing retaining wall 26 are connected at their proximal ends by the outlet base ring 24. Formed about the inner periphery of the distal edge of the retaining wall 26 is retention rib 27, which extends inwardly towards the outer surface of protuberance 28.

The self-sealing nozzle 30 can comprise any check valve which permits extrusion of product outwardly under pressure and provides for clean cut-off and sealing on release of pressure. The particular embodiment shown is preferably injection molded of silicone rubber (e.g. Silastic$^R$ MDX 4-4526 available from Dow-Corning of Midland, Mich.), although a wide variety of materials and forming procedures can be used. The nozzle 30 is shown in FIG. 1 as comprising four leaves or flutes 31, however, it is contemplated that alternate nozzles with varying structures and number of leaves can be successfully utilized to provide a check valve and a self-sealing closure for the dispensing package. As can best be seen in the cross-sectional view of FIG. 2, the nozzle 30 interior is formed with a generally cylindrical open inlet end 32 and an outlet end which terminates in interconnecting closed slits 33 intermediate the individual flutes 31. Nozzle 30 is preferably formed with wall thicknesses of approximately 0.76 mm (0.03 inches) in its cylindrical open end 32 and 0.51 mm (0.02 inches) in its flutes 31. An attachment flange 34 is integrally formed at the bottom edge of open end 32 and extends outwardly in a plane substantially perpendicular to the central axis of nozzle 30. It is preferred that nozzle 30 be molded with the flutes 31 closed at their distal end, and thereafter cutting the slits 33 as desired to insure that such slits 33 will have the capability to fully close. The ability to close is important because nozzle 30 must be capable of preventing flow of fluid into the dispenser package.

Nozzle 30 is mounted onto dispensing package 10 by telescoping its cylindrical open end 32 over protuberance 28, and is positively held in place by a retaining ring 40 which slides over the exterior of nozzle 30 and is snapped past the inwardly extending retention rib 27 of the retaining wall 26. Retaining ring 40 is preferably made of polypropylene or polyethylene, but can be made of any relatively rigid material. The dimensions of sealing ring 40 and the location of the rib 27 are such as to insure that upon its application the sealing ring 40 will be biased against flange 34, thereby establishing a tight seal of flange 34 against the outlet base ring 24. The manner of attachment of nozzle 30 to the package is not critical, however, and can be accomplished by a variety of ways known or conceivable by those skilled in the art, such as by adhesives, spin-welding, or other mechanical arrangements. It might also be desirable to attach nozzle 30 internally adjacent the discharge passageway (e.g. within an extended outlet channel).

A one-piece follower piston 70 preferably made of polypropylene or polyethylene (although any resilient material will suffice) is slidingly mounted within the container body 51 of dispensing package 10, as shown in FIG. 2. In the embodiment shown, piston 70 exhibits a convex face 76 integrally attached about its lower outer periphery to a depending sidewall including the thin-walled, bellows-like concavities or corrugated segments 73. The convex face 76 can have a radius of curvature of about 38 mm (1.5 inches) for use in container body 50 having an inside diameter of approximately 41.3 mm (1.625 inches), however, as will be shown, the curvature of face 76 is subject to modification in any particular execution. Each individual concavity (or bellows) 73 is made up of one upwardly facing frusto-conically shaped wall section 74 and one downwardly facing frusto-conically shaped wall section 75, said sections being hingedly connected at their intersection 72. The individual concavities 73 are connected to one another at their upper and lower extremes by integral contact bands 78, and the uppermost bellows is similarly connected to the lower outer periphery of the piston face 76 along a separate peripheral contact band 78. As can be seen in the cross-sectional view of FIG. 3, piston 70 is hollow and the inner surfaces of piston face 76 and the depending sidewall and its concavities 73 are exposed to ambient air as a result of the open bottom of piston 70.

The term "bellows-like" is used herein to connote any thin-walled corrugated or accordion-like structure integrally formed as part of the continuous sidewall of a piston, which takes the structural form of a resilient peripheral, reentrant section of the sidewall and permits the piston sidewall to longitudinally extend or contract in response to axial pressure forces exerted on the piston face, with such change in length resulting in inversely proportional change in lateral dimension of at least one peripheral contact band formed in the sidewall. For example, the resilient concavities 73 of piston 70 permit piston 70 to be longitudinally compressed in response to downward pressure exerted on piston face 76 and, in an unrestricted environment, this results in a proportional expansion of the outer diameters of contact bands 78. Piston 70 is hollow and its open bottom permits the longitudinal extension or contraction of the piston sidewall without interference of air which might otherwise be trapped within the piston (i.e. axial forces act upon the opposing surfaces of piston face 76).

Figure 4:
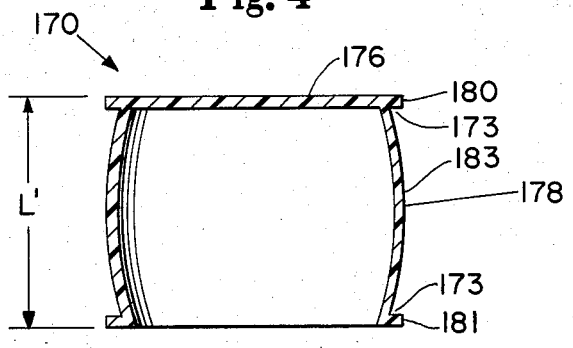
FIG. 4 is a vertical cross-sectional view of an alternate embodiment of the follower piston of the present invention.

A piston exhibiting a bellows-like concavity with only a single peripheral contact band is illustrated by piston 170 in the cross sectional view of FIG. 4. Piston 170 includes a substantially rigid piston face 176, a depending sidewall 183, a friction ring 181, and a peripheral contact band 178 formed in the sidewall, intermediate face 176 and friction ring 181. The convex conformation of sidewall 183 creates the resilient, reentrant sections 173 which permit the piston sidewall 183 to longitudinally extend or contract in an unrestricted environment, which such change in length resulting in inversely proportional change in lateral dimensions of the peripheral contact band 178. Friction ring 181 establishes a predetermined amount of frictional resistance to movement of piston 170 within the bore of a dispenser to allow axial forces to act upon piston face 176, thereby longitudinally extending or contracting the piston sidewall 183 (as will be discussed in more detail below). Any means for establishing a predetermined normal force against the inner surfaces of tubular portion 51 (i.e. frictional resistance to movement) could be incorporated in place of friction ring 181. Piston 170 also demonstrates that the peripheral contact bands of pistons made in accordance with the present invention need not exhibit structural characteristics identifiably separable from the sidewall structure itself, as the contact bands 178 of piston 170 are defined as the radially largest continuous dimension of sidewall 183. It may be preferred in some executions to form contact band 178 of piston 170 as an outwardly extending rib-like structure (not shown) to improve its sealing capabilities with the inner surfaces of the bore of a dispenser.

Referring again to FIGS. 1–3, the peripheral contact bands 78 of piston 70 conform to the shape of the inner cross section of tubular portion 51, and are dimensioned to provide an interference fit within tubular portion 51 which exerts a predetermined normal force against the inner surfaces of the bore thereby establishing a predetermined amount of frictional resistance to both upward and downward displacement of the piston 70 within the container body 50. Because actual lateral expansion of the contact bands 78 is prevented by the substantially rigid inner wall surfaces of the bore tubular portion 51, axial compressive force (such as caused by pressure applied to the upper surface of face portion 76) is transmitted to the bellow-like concavities 73 and converted into increased normal force of contact bands 78 pressing against the inner wall surfaces of tubular portion 51, thereby increasing the frictional resistance of piston 70 to downward displacement within container body 50. Correspondingly, an axial extensive force applied to piston 70 (such as caused by pressure acting in the lower surface of face portion 76) would produce or tend to produce a proportional decrease of the outer diameters of contact bands 78, thereby reducing the normal force exerted by contact bands 78 against the tubular portion 51 and correspondingly reducing the frictional resistance of piston 70 to upward displacement.

Although the bellows-like concavities 73 of piston 70 shown in FIGS. 2, 3, 7 and 8 exhibit a saw-tooth or squarely-defined conformation, other bellows-like configurations can also be utilized. For example, the bellows-like concavities 73 could be formed with rounded intersections 72 and/or rounded contact bands 78 as opposed to the sharp configurations shown. Such a rounded contact band is illustrated at 178 of the piston 170 shown in FIG. 4.

The operational function of piston 170 of FIG. 4 corresponds to that described above with respect to piston 70. The friction ring 181 and the contact band 178 of piston 170 conform to the shape of the inner cross section of a dispenser bore, such as tubular portion 51, and are dimensioned to provide an interference fit within tubular portion 51 to establish normal forces against the inner surfaces thereof, thereby creating a predetermined amount of frictional resistance to both upward and downward displacement of piston 170 therewithin—a function corresponding to that of contact bands 78 of piston 70. The outer periphery 180 of piston face 176 may also be dimensioned to establish a seal and/or a predetermined amount of frictional resistance to axial displacement with the inner surfaces of tubular portion 51. Axial compressive force exerted on the upper surface of piston face 176 is transmitted to the bellows-like concavities 173 formed in sidewall 183, and because friction ring 181 frictionally resists downward displacement, such transmitted forces tend to collapse the thin-walled sidewall 183 outwardly, resulting in an increased radial dimension of contact band 178. Because the tubular portion 51 prevents any actual radial dimensional expansion, such dimensional change is virtual and actually results in increase normal force of contact band 178 against the inner wall surfaces of tubular portion 51, thereby increasing the frictional resistance of piston 170 to downward displacement. Correspondingly, an axial extensive force applied to piston 170 would tend to longitudinally extend sidewall 183 tending to reduce the radial dimensions of contact band 178 thereby reducing the normal forces and the resulting frictional resistance to upward displacement of piston 170.

The overall length of follower piston 70 of FIG. 3 depends at least in part on the size and number of individual concavities 73 present. An individual concavity 73 is described by its included angle 77 and its pitch H, as shown in FIG. 3. Included angle 77 further comprises a downward facing angle $\alpha$ and an upward facing angle $\beta$. Preferably angle 77 is in the range of from about 30° to about 120° and the angles $\alpha$ and $\beta$ are approximately equal. The pitch H is the distance measured between the centers of two successive contact bands 78, as indicated in FIG. 3. As will be described in more detail later, the frictional resistance to displacement of the follower piston 70 can be varied to suit any particular functional need by changing the included angle 77 of some or all of the individual concavities 73 in a particular piston. The pitch H can also be adjusted in a particular execution to vary the overall length of the piston 70, however, techniques of molding the piston may limit how far pitch H may be reduced (with any particular sidewall thickness of a piston) while maintaining good structural definition of the individual bellows or concavities.

The piston 70 is formed as shown with four complete individual concavities 73, having an included angle 77 of about 60°, with $\alpha$ and $\beta$ each being about 30°. It has been found that a pitch of at least about 3.2 mm (0.125 inches) is preferred to obtain good definition of the individual concavities 73 in an extrusion blow-molding forming process. While a smaller pitch H can be successfully formed, a pitch smaller than about 4.5 mm tends to negatively affect the total variability in lateral dimensions of concavities 73 and, thus, negatively affect piston performance. It is preferred that pitch H equal at least 10% of the outside diameter of piston 70. It has also been found necessary for the piston 70 to be of sufficient length to resist axial misalignment within the container during its operable life. What is sufficient, of course, will vary with the diameter of the package. For example, if the inner diameter or bore of tubular portion 51 of the described embodiment is approximately 41.3 mm (1.625 inches), it has been found that an approximate length L of piston contact (length L is measured between the uppermost and lowermost contact bands 78, as shown in FIG. 3) of at least 12.7 mm (0.5 inches) is preferred to prevent axial misalignment of the piston 70 within the container. A piston having an included angle 77 of 60°, with $\alpha$ and $\beta$ each being equal to 30°, and having a pitch of 4.5 mm (0.175 inches), requires approximately three bellows 73 to obtain a length of 12.7 mm (0.5 inches). Likewise, piston 170, as illustrated in FIG. 4, should also be of sufficient length to resist axial misalignment within the container. The overall length of piston 170 is determined most importantly by the length of the convex sidewall 183, and a piston length L' of at least 12.7 mm (0.5 inches) is preferred for use within a tubular bore 51 having an inside diameter of approximately 41.3 mm (1.625 inches).

Pistons 70 and 170 can be made of a wide range of resilient materials (e.g., polymers having a flexural modulus in the range of 700 to 28,000 $Kg/cm^2$ or 10,000 to 400,000 psi) exhibiting strength which is capable of maintaining substantial stability under successive loaded and unloaded conditions over extended periods of time. Thermoplastic materials are preferred for their lower cost and ease of forming.

In order to establish a predetermined amount of frictional resistance of piston 70 to both upward and downward displacement within container body 50, piston 70 is preferably formed with an outside diameter of its contact bands 78 approximately 0.25 mm (0.010 inches) larger than the inside diameter (bore) of the tubular portion 51. Such intentionally oversized dimensions provide an interference fit which develops internal forces within the resilient piston 70 having a predetermined component acting normal to the bore of the tubular portion 51 along the contact bands 78, thereby establishing a predetermined frictional resistance to displacement. The predetermined minimum frictional resistance to displacement of said piston 70 also can be measurably controlled by parameters other than varying the amount of engineered interference between the parts. For example, varying piston material, material softness (durometer) and wall thickness also affect frictional resistance to displacement. Because each contact band 78 adds an increment of frictional resistance to the total frictional resistance of piston 70, the number of contact bands 78 is also a factor. The correct number of contact bands can vary widely depending on the particular frictional requirements for proper dispensing operation of the required package, (i.e., the piston must withstand downward dispensing pressure without substantial downward displacement, yet allow atmospheric pressure to move it forward following such dispensing operation) and sealing requirements within the package. While any particular piston must have at least one contact band 78, a plurality of contact bands 78 (e.g. three or four) is preferred to establish sufficient friction and redundant seals within a broad spectrum of packages.

Corresponding interference fits of friction ring 181, contact band 178, and the outer periphery 180 of piston face 176 within tubular portion 51 can likewise be utilized to establish the predetermined amount of frictional resistance to axial displacement of piston 170 within container body 50. In a preferred embodiment, friction ring 181 and contact band 178 are formed with an outside diameter approximately 0.38 mm (0.015 inches larger than the inside diameter of tubular portion 51, while the outer periphery 180 of piston face 176 is formed approximately 0.13 mm (0.005 inches) larger.

Figure 5:
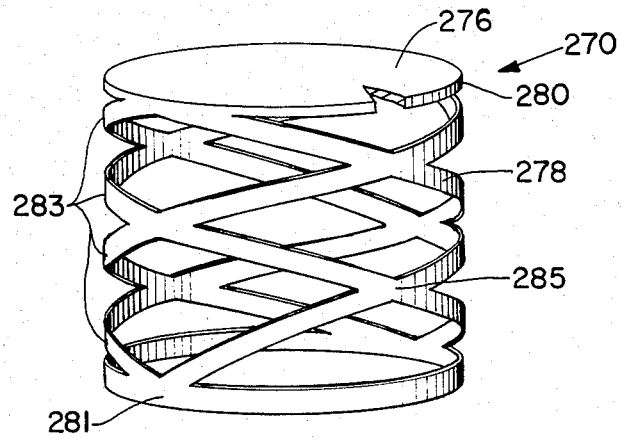
FIG. 5 is a perspective view including a partially broken away section of yet another embodiment of the follower piston of the present invention.

FIG. 5 illustrates yet another embodiment of a piston made in accordance with the teachings of the present invention. Particularly, piston 270 illustrates that the peripherally attached sidewall of a piston made in accordance with the present invention need not necessarily be formed with a thin-walled, reentrant, bellows-like concavity formed thereabout in order to be capable of virtually resiliently longitudinally extending or contracting in response to axial forces exerted on its face portion, with such change in length resulting in an inversely proportional virtual change in lateral dimension of its peripheral contact band. It is contemplated that the sidewall of a piston made in accordance with the present invention can comprise any structure having at least one integral peripheral contact band which conforms to the shape of the cross section of the bore and which is adapted to exhibit the described longitudinal and lateral dimensional changes in response to axial forces exerted on the face portion of the piston.

Follower piston 270 can be formed of any resilient material, as described with respect to piston 70, and comprises the relatively thin but rigid flat face 276, a depending sidewall 283, and friction ring 281. Depending sidewall 283 is formed of four interconnected helical strips 278 depending from the lower outer periphery of face 276 and attached at their lower portions to the upper outer periphery of friction ring 281. The piston of FIG. 5 features two right-handed and two left-handed helical strips 278, each making one complete helical revolution as it spirals from face 276 to friction 281. Helical strips 278 form a crisscrossing arrangement and are connected to one another at their intersections 285, resulting in a web-like or perforated continuous structure making up sidewall 283. Helical strips 278 also function as peripheral contact bands which conform to the shape of the cross section of the bore of a dispenser, and are preferably dimensioned to provide an interference fit within the bore which exerts a predetermined normal force against the inner surfaces of the bore in static condition. Friction ring 281 is also dimensioned to establish a predetermined amount of frictional resistance to movement of piston 270 within the bore of a dispenser to allow axial forces to act upon the piston face 276, thereby longitudinally extending or contracting the piston sidewall 283. Outer periphery 280 of piston 276 is likewise dimensioned to establish a predetermined normal force against the inner surfaces of the dispenser bore, and also establishes a seal with the bore to retain product thereabove.

The frictional resistance to movement established by friction ring 281 allows axial forces acting upon piston face 276 to longitudinally extend or contract sidewall 283. The individual helical strips 278 naturally tend to expand laterally when compressed longitudinally, and inversely contract laterally upon longitudinal extension. The interconnection of a pair of oppositely disposed (i.e. one left-handed and one right-handed) helical strips 278 insures such lateral dimension change in response to longitudinal stress by preventing the individual strips from twisting (as they would do in an unrestrained environment to relieve such longitudinal stress). While it has been found that at least two oppositely disposed helical strips 278 appears to be preferred to prevent such twisting action, it is contemplated that any number of helical strips 278 could be successfully utilized, and that their interconnecting pattern, spacing, etc., could be varied as desired.

Piston 270 illustrates that a peripherally attached sidewall adapted to virtually resiliently longitudinally extend or contract in response to axial forces exerted on the face portion of a piston made in accordance with the present invention, with such change in length resulting in an inversely proportional change in lateral dimension of the peripheral contact band(s), can be formed in a variety of ways. One way of forming a sidewall, exhibiting such characteristics is to perforate a cylindrical tube-like sidewall in such a pattern (e.g. such as to form the helical/diamond pattern shown in FIG. 5) as to impart the desired functional characteristics.

The package 10 is preferably initially partially assembled in the manner described, omitting the follower piston. The partially assembled package 10 is then inverted and bottom-filled with product, leaving sufficient unfilled space in the open end of the bore of container body 50 for piston 70 (or piston 170, piston 270, or any other piston made in accordance with the present invention) to thereafter be inserted within container body 50. Following insertion of piston 70, a container bottom cover (not shown) might be placed over the open end of container body 50 for aesthetic reasons, however, such a cover must not prevent the maintenance of ambient air pressure within the hollow rear portion of piston 70 which could interfere with the operation of package 10. The method of filling package 10 is not critical, and any appropriate process can be utilized.

In operation, the rounded section 21 of resilient top 20 is manually depressed, thereby decreasing the volume within the dispensing package and resulting in a pressure rise in the product therein. Pressure changes within the dispensing package are transferred through the mass of fluid product housed therein and exerted on the piston face 76. The force generated by the pressure exerted upon face 76 is transferred therethrough to the appended sidewall and because piston 70 has been designed to exhibit a certain minimum frictional resistance to backward displacement within the dispensing package, the force tends to virtually compress the corrugated segments (concavities) 73 therebelow. The term "virtual" is used herein to signify that the various parts of piston 70, which when loaded or unloaded in an unrestricted environment would actually compress or expand, exhibit only minuscule compression or expansion in the physically restricted environment of container body 50. Virtual expansion or compression, therefore, is used to describe what is in reality the transfer of loads and forces by the structure of piston 70.

It is observed that the sidewalls of the pistons described above include structural elements (e.g. concavities 73, or helical strips 278) which are non-parallel to a longitudinal axis of the piston and which deflect longitudinally in response to axial forces imposed thereon, with such deflection tending to cause inversely proportional lateral dimensional changes in such sidewalls. Virtual axial compression of corrugated segments (concavities) 73 causes piston 70 sidewall to virtually expand its lateral dimension at contact bands 78. Due to its convex nature, piston face 76 augments the piston's virtual lateral dimension growth in response to the increased pressure in the product by itself tending to radially expand its effective diameter. Piston face 76, however, is preferably a substantially rigid structure because to the extent it deforms upon loading, it will reduce the volume dispensed. One way of insuring substantial rigidity of face 76 is to increase the thickness of its structure. In a preferred execution, the wall thickness of face 76 is approximately 1.65 mm (0.065 inches), while the appended sidewall and the bellows (concavities) 73 have a wall thickness of approximately 0.64 mm (0.025 inches). Corresponding wall thicknesses can be successfully utilized in the face 176 and sidewall 183 of piston 170.

The tendency of piston 70 to expand its lateral dimension in response to increased pressure within the dispensing package 10 results in greatly increased normal forces exerted by the piston along its contact bands 78 against the inner surfaces of the bore of tubular portion 51 and proportionally increased piston 70 resistance to rearward displacement within the dispensing package 10. Such increased resistance to displacement allows the pressure to increase within the dispensing package as the resilient top 20 is further depressed. Internal pressure increases until it exceeds the threshold pressure required to commence dispensing through nozzle 30. In the described embodiment, such threshold pressure will be the sum of the pressure drop required to extrude the fluid product housed in the container through the relatively small passageway 23 (which in a preferred embodiment is approximately 6.4 mm or 0.25 inches in diameter), plus the pressure required to open the flutes 31 of nozzle 30, plus the pressure required to push said product through the flutes 31 once opened. The dispensing pressure for any particular dispensing package can therefore be predetermined and controlled by varying the dispensing passageway size and/or the functional properties of the nozzle, while taking into consideration the viscosity of the product to be dispensed. The dispensing pressure required in the described embodiment is approximately 0.11 $Kg/cm^2$ [1.5 pounds per square inch (psig)] when a fluid product of 300,000 cp (Brookfield) viscosity is housed therein.

When the pressure within the dispensing package 10 reaches the threshold dispensing pressure at the dispensing passageway 23, product will be dispensed and such dispensing will continue until the pressure in the dispenser falls below that threshold pressure. Upon release of the force depressing top 20, pressure within the dispensing package begins to drop as the resilient top 20 returns toward its original position. When such internal pressure approaches atmospheric pressure, the nozzle 30 will tend to resiliently close due to the elastic memory of its material. As the resilient top 20 continues to move toward its original position, a partial vacuum is established within the dispensing package 10. Such negative pressure causes atmospheric pressure to act upon the exterior surfaces of the leaves 31 of nozzle 30, sealing the slits 33 and thus closing the nozzle in a substantially fluid-tight condition. The partial vacuum within the package 10, therefore, obtains no substantial relief through the nozzle 30 or through the seals created between the contact bands 78 and the inner wall surfaces of tubular portion 51, which are capable of preventing the entry of ambient air into the dispensing package. In a preferred embodiment, the 0.25 mm (0.010 inches) of interference fit between the piston 70 and the inner diameter of tubular portion 51 insures an adequate redundant seal with the five (5) contact bands 78. Other means of providing a fluid-tight seal of said piston 70 within the container body 50 could be equally successfully employed.

The imbalance of pressure which acts upon the piston face 76 (i.e. the vacuum acting on the upper surface and atmospheric pressure on the lower surface) imposes an effective upward force thereon, virtually stretching (or increasing pitch H) the successive individual corrugated segments 73 in an upward direction, thereby tending to decrease the effective diameter of such individual corrugated segments 73 and of the piston 70. This tendency lessens the normal force exerted by the corrugated segments 73 at their contact bands 78 against the bore of the tubular portion 51, which proportionally decreases the piston's frictional resistance to movement within the dispensing package and facilitates its upward displacement therein. Piston 70 is displaced upwardly a distance generally corresponding to the amount of fluid product dispensed, acting to relieve the partial vacuum created by the recovery of resilient top 20, at which point equilibrium is reached by achieving a rough balance involving the opposing pressures and the system's resistance to further piston movement. The dispensing package 10 is now ready for another dispensing operation.

The operation of dispensing package 10 in conjunction with piston 170 (or piston 270) would be substantially identical to that described above with regard to piston 70, with axial pressure forces acting on piston face 176 (or face 276) and being transferred into virtual lateral dimensional expansion or contraction of contact band 178 (or helical strips 278). The frictional resistance established by friction ring 181 of piston 170 (or similarly ring 281 of piston 270), however, will remain substantially constant throughout operation of the dispenser.

Figure 6:
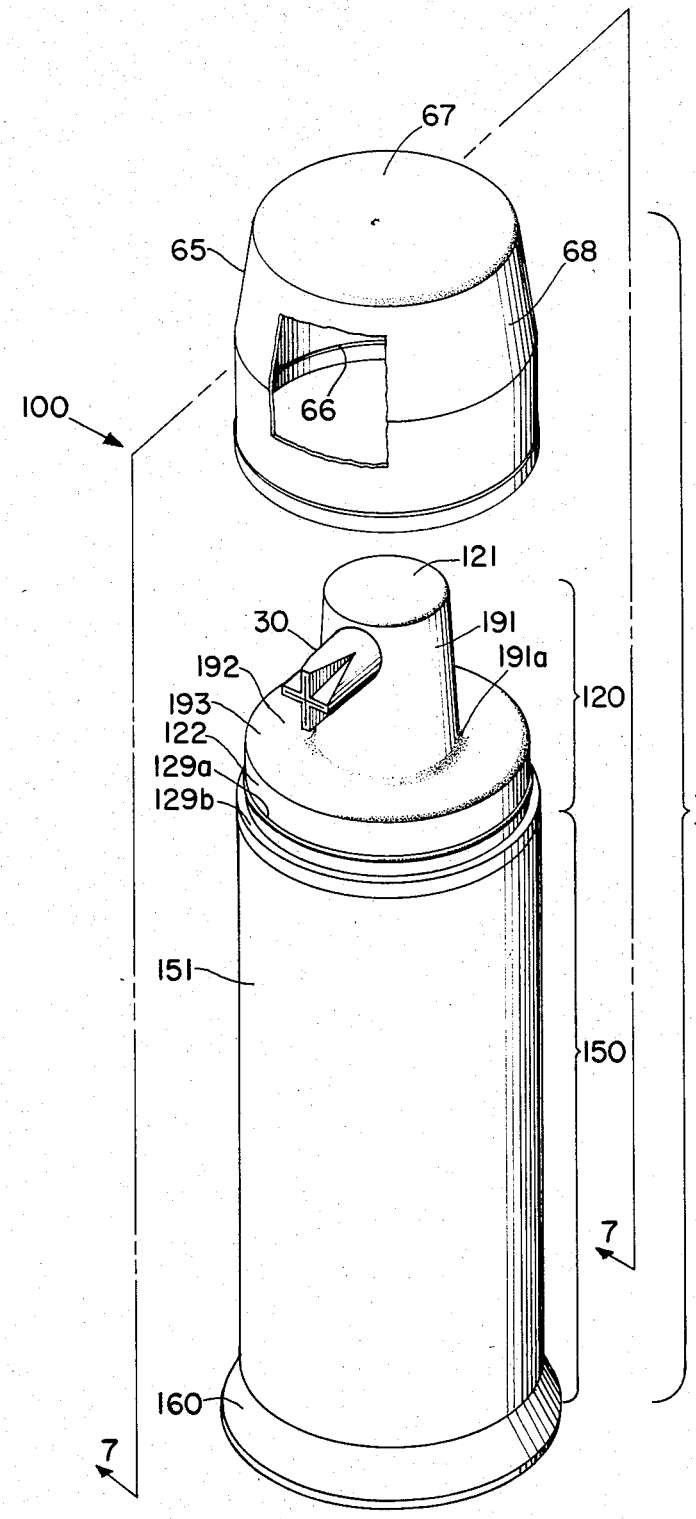
FIG. 6 is a partially exploded perspective view of a second preferred embodiment of a dispenser incorporating the follower device of the present invention.
Figure 7:
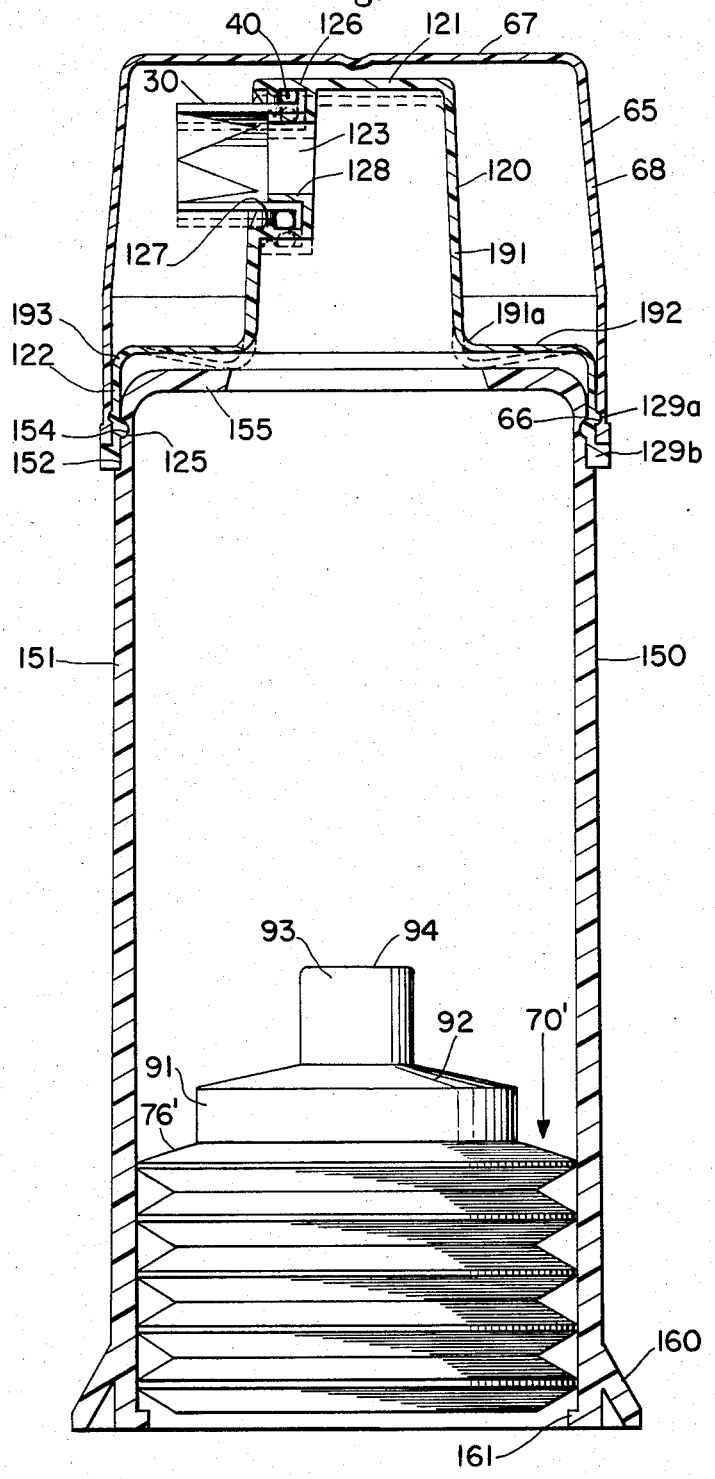
FIG. 7 is an enlarged vertical cross-sectional view of said second preferred embodiment of FIG. 4 taken along the line 6—6.
Figure 8:
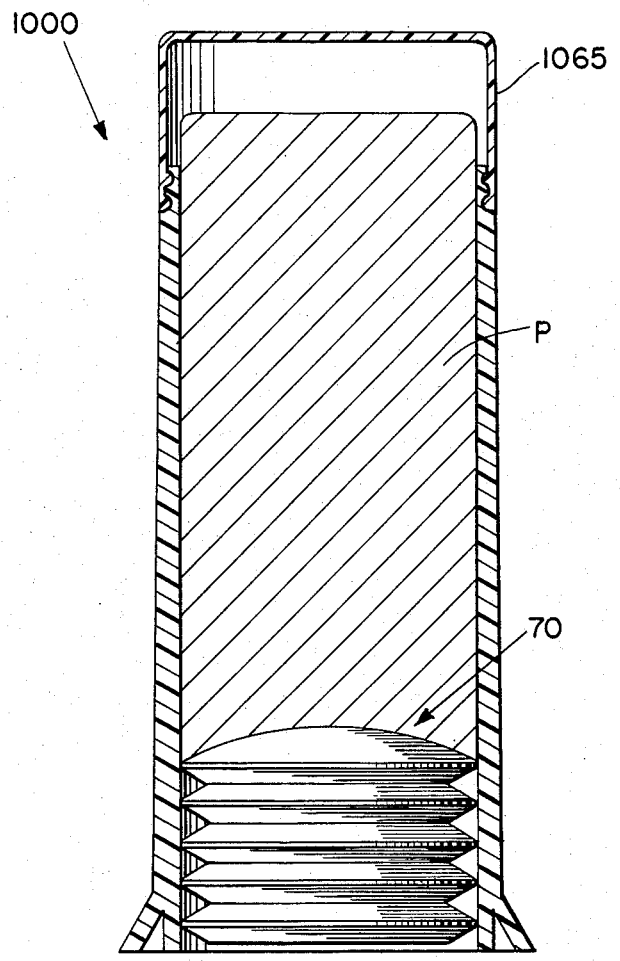
FIG. 8 is a vertical cross-sectional view of a third embodiment of a dispenser incorporating the follower device of the present invention.

FIGS. 6 and 7 illustrate an alternate and equally preferred embodiment of the subject dispensing package. Particularly, those drawings illustrate a dispensing package 100 comprising the container body 150 for housing a mass of fluid product to be dispensed, a resilient dispensing top 120, a self-sealing dispensing nozzle 30, a follower piston 70' and an overcap 65. As with dispensing package 10, pistons 70, 170 or 270 can be readily substituted for piston 70' with equal success in package 100. As is apparent from the drawings, container body 150 is substantially similar to container body 50 as described above. The tubular portion 151, recessed portion 152, snap-fitment groove 154, and base 160 correspond exactly to parts 51, 52, 54 and 60, respectively, of the first described embodiment. A support wall 155 extends inwardly from the upper inner surfaces of the bore of tubular portion 151 and partially closes the uppermost end of container body 150. A plurality of piston stops 161 are integrally formed in spaced relation about the lowermost inner periphery of container body 150, and comprise generally rectangular protuberances extending inwardly a relatively short distance toward the central axis of container body 150. Piston stops 161 are shown simply as an example of means for initially insuring the retention of piston 70' within the container body 150 during shipping and initial use. Similar means could also be incorporated into the dispensing package 10 as described above. Overcap 65 is of generally cup-like shape and comprises a substantially flat circular top portion 67, a depending sidewall 68, and snap-fitment groove 66 formed about the lower inner periphery of sidewall 68.

The resilient dispensing top 120 is an integral structure and comprises a rigid button top 121, a depending cylindrical button wall 191, rounded base **191*a*, concentric diaphragm 192, a substantially rigid shoulder area 193, and the rigid skirt 122. Dispensing top 120 is preferably molded of resilient material (e.g. polypropylene, polyethylene terephthalate, polyacrylonitrile, elastomers, or polymer composites) having a thickness of between 0.38 and 0.51 mm (0.015–0.020 inches) in its concentric diaphragm 192, and slightly thicker in the balance of its structure. The thickened areas are designed to remain substantially rigid throughout a dispensing operation while the thinner diaphragm 192 deflects thereby varying the volume of package 100. As shown in FIG. 7, snap-fitment rib 125 is formed on the lower inner periphery of depending skirt 122 to form a fluid-tight snap fitment with upper recessed portion 152 and the snap-fitment groove 154 of container body 150. This snap-fitment arrangement, as well as the corresponding arrangement described in the first embodiment above, are provided only as examples as other connecting means could alternatively be utilized, or the resilient dispensing top 120 and container body 150** could be unitarily molded, thus obviating a need for connection means.

A dispensing passageway 123 is formed through the cylindrical button wall 191 and comprises an outwardly extending tubular section 128, a circumscribing retaining wall 126, and a retention rib 127 extending inwardly about the inner surfaces of the retaining wall 126. Again, such arrangement is provided as an example for mounting the dispensing nozzle 30 onto dispensing package 100, however, many other methods for such attachment are available or conceivable by one skilled in the art. The self-sealing nozzle 30 is identical to nozzle 30 as described in the previous embodiment above.

Piston 70' is essentially identical to piston 70 as described above, except that the face portion of piston 70' has been modified to nest with the conformation of the inner surfaces of the upper portions of package 100. A substantially circular disk portion 91 having a frustoconical upper face 92 extends upwardly from the piston face 76' and is attached thereto about its lower outer periphery. Extending upwardly from the central area of flat portion 92 is the protuberance 93 having a flat top surface 94. The disk surface 91 is dimensioned to slide past the inner surfaces of the support wall 155 and allow piston 70' to move upwardly within container body 150 until the piston face 76' meets the lower surfaces of support wall 155. Protuberance 93 will likewise telescope upwardly within dispensing top 120 and insure that most of the contained product will be dispensed. Modifying piston faces in this manner is one way of minimizing product waste in product dispensers.

Snap-fitment rib **129*a* extending outwardly from the periphery of skirt 122, and stop flange 129*b* similarly extending from the outer distal edge of skirt 122 are included as an example of means for attaching overcap 65 to the dispensing package 100. Snap-fitment groove 66 of overcap 65 lockingly interacts with rib 129*a* when overcap 65 is telescoped over dispensing top 120** into closed position.

The operation of dispensing package 100 is identical to that described above with regard to the dispensing system 10, with the exception of the manner in which the volume of the package is to be varied. The resilient top 20 of dispensing package 10 and the resilient dispensing top 120 of dispensing package 100 are provided only as examples of means for varying the volume of the subject dispensing package. It is contemplated that many alternate structures for accomplishing such volume variation are available or conceivable by those skilled in the art. Particular executions of such volume varying means can be designed to optimize the required force and/or stroke length necessary to provide a predetermined amount of volume variance within a specific dispenser. For example, such means might be designed to require a relatively large amount of axial displacement (stroke length) of a relatively small surface area to provide a predetermined volume variance while requiring relatively less axial force to produce the required dispensing pressure. This advantage can facilitate the dispenser's use by small children. The volume varying means can therefore be a valuable tool in optimizing the functional characteristics of a dispensing package to correspond to customized usage and/or convenience considerations.

Again, package 100 is preferably partially assembled without piston 70' (or 70, or 170, or 270, etc.) for bottom filling the product as described above with regard to package 10. Following such bottom filling, piston 70' is inserted into container body 150 such that the lowermost contact band 78 (or if piston 170 is used, the friction ring 181) is snapped past the piston stops 161. In operation, downward manual force is imposed upon the button top 121 thereby axially depressing said button top 121 and the rigid cylindrical button wall 191 and causing inward deflection of the concentric diaphragm 192, as indicated by the dotted lines of FIG. 7. Such axial displacement of the resilient top 120 results in a volume reduction within the dispensing system 100 and causes pressure within said system to rise. As described in relation to the first embodiment, the follower piston 70' resists rearward displacement in response to such rising pressure and fluid product will be dispensed through the dispensing passageway 123 when the internal pressure reaches the necessary level. It has been found that in some designs of the volume varying means, such as the resilient dispensing top 120, excessive downward force imposed thereon can cause irreversible deformation of said means. For example, excessive downward force upon the button top 121 of the embodiment 100 might cause excessive strain or catastrophic failure at the rounded base 191*a* of the wall 191 or in the vicinity of the peripheral shoulder 193, which could render the entire dispensing system inoperable. One way to prevent such failure is to design into the dispensing system means for positively limiting the axial travel of the volume varying means. An example of such a positive limitation means is illustrated in FIG. 7, which shows the support wall 155. Proper positioning of such limitation means can also serve to meter individual doses dispensed in single dispensing operations.

It has been found that pistons can be designed to exhibit a desired degree of preferential resistance to axial displacement in either an upward or downward direction. In the embodiments described above, piston 70 features a structure of interconnected corrugated concavities or bellows 73 which tend to increase said piston's resistance to downward displacement in response to increased pressure within the dispensing package—and which tend to decrease said piston's resistance to upward displacement in response to vacuum (or negative pressure) within the package. Piston 70, as described, therefore will show a preference to upward axial movement. The magnitude and character of a piston's preference may be adjusted in several ways, for example varying the included angle 77 and/or the individual angles $\alpha$ and $\beta$. While the preferred range for included angle 77 is between 30° and 120°, theoretically the included angle of any particular bellows 73 could range from 0° to 180°. It has been found, however, that with large angles there is little tendency for lateral dimensional expansion of the individual bellows with virtual axial compression thereof and, therefore, little resulting preferential frictional resistance to displacement. When angles $\alpha$ and/or $\beta$ are nearer the minimum value of 0° (for example 15°), a bellows-collapsing force will result in a very limited degree of virtual lateral dimensional expansion of the individual bellows, but higher normal forces exerted against the inner container walls, resulting in a piston with less lateral dimensional variability and higher frictional resistance to displacement under load. Increasing the size of the angles results in more laterally variant piston diameters (i.e., more tolerant to a designed interference between the piston and the inner wall surfaces of a container in spite of container inner dimension differences), but less preferential frictional resistance (i.e., less increase in the normal forces exerted against the inner container walls for a given load on the piston) to displacement. Once included angle 77 is increased beyond 120°, however, both tolerance and preferential frictional resistance begin to decrease. Included angles of individual bellows may therefore be adjusted to create a follower piston having a desired latitude of interference within a container, exact optimal tolerance, and frictional resistance for any individual dispensing package. Greater piston tolerance can be very beneficial in compensating for manufacturing variations of container and piston dimensions common to high speed mass-production situations. Therefore, the trade-off of less preferential frictional resistance for greater piston tolerance can be balanced as the circumstances dictate. Although the angles $\alpha$ and $\beta$ are described in the embodiments as being approximately equal, this need not be the case. It has been found that only one of the angles $\alpha$ or $\beta$ must be small (e.g. 15°) to achieve higher preferential resistance under load, while the other angle can be large. Such a combination could be useful in facilitating the molding procedures of a piston having small pitch and a small angle $\alpha$ or $\beta$, as less intricate mold conformations would be required.

In the embodiments described, the piston face 76 is shown having a convex surface with a preferred radius of curvature of about 38 mm (1.50 inches) and being located adjacent the uppermost bellows 73. Another way in which piston performance may be tuned to a particular dispensing need is by varying the shape and location of the face 76. For example, a flat piston face could be horizontally affixed centrally with a bellows piston, leaving both ends of said piston open. Such a piston would have no preference to displacement within a package. Slight preference to displacement in the upward direction could be accomplished by locating said flat piston face closer to the upper end of said piston. If piston face 76, as described herein, were upwardly concave as opposed to convex, instead of augmenting the tendency of the uppermost bellows to virtually radially expand in response to downward pressure, it would tend to radially expand in response to upward pressure, thereby slightly increasing frictional resistance to upward displacement and improving the seal at the uppermost contact band 78 of the piston. Such a concave shape might be desirable to insure airtight seals of contained fluid products which are sensitive to air. Likewise with other pistons made in accordance with this disclosure, the piston face can assume a variety of shapes and thicknesses according to specific functional characteristics desired. For example, an upwardly convex face 176 of piston 170 might preferably be of thinner thickness so that it can more easily virtually radially expand in response to downward axial pressure, thereby augmenting the seal between the outer periphery 180 and the inner surfaces of tubular portion 51. Piston faces can be correspondingly shaped with various concave or convex diameters, or with mixed combinations of flat, concave and convex conformations to precisely control piston performance characteristics. Custom-shaped piston faces can also be utilized to allow the piston to nest with the conformation of the upper portions of a pump dispenser to insure that substantially all the contained product will be dispensed, thereby reducing product waste (e.g. piston 70' of FIG. 7).

It has also been found that to prudently match the predetermined frictional resistance of the piston within the container, the volume (and pressure) varying capabilities of the volume varying means, the piston face configuration and the pressure requirements for dispensing, the viscosity and lubricity of the fluid product to be dispensed must be considered. Viscosity can substantially affect the pressure drop across the dispensing conduit and may also be key in determining the number and type of sealing means required for said piston to effectively operate and protect said fluid within the dispensing package. For example, an upwardly concave piston face 76 would probably be desirable to insure a fluid-tight seal of fluid products sensitive to air which have relatively low viscosities, whereas, an upwardly convex or flat face might be sufficient with a fluid of relatively high viscosity. It has been observed that higher viscosity fluids tend to augment the reliability of the piston seals. Lubricity of a contained fluid and the inherent coefficient of friction of the particular materials chosen for the follower piston and the container body logically tend to have a direct effect on friction values within the dispensing system, and such effects must be considered in the design requirements of each particular execution.

Pistons, as described herein, also have applicability as follower devices in any product dispenser which houses the product in an axially extending bore wherein the piston can be slidably mounted. For example, piston 70 could be utilized in a solid product dispenser, as illustrated in the cross-sectional view of FIG. 8, wherein piston 70 is slidably mounted in the lower end of the axial bore of the dispenser 1000 supporting the solid product P thereabove, and wherein piston 70 is to be manually pushed upwardly within the axial bore to dispense the product. Dispenser 1000 is shown with cylindrical conformation, although various shapes of the outer and inner surfaces could be utilized. Dispenser 1000 is also shown with a snap-on cap 1065 in closed position; however, cap 1065 is shown only as an example of closure means for such a dispenser. This dispenser execution would be especially advantageous for use with solid products such as stick type deodorants which are to be rubbed onto axilla surfaces, in use, because piston 70 would resist backward displacement within the axial bore in response to the axial compressive force created by such rubbing during the dispensing operation.

Figures 9, 10:
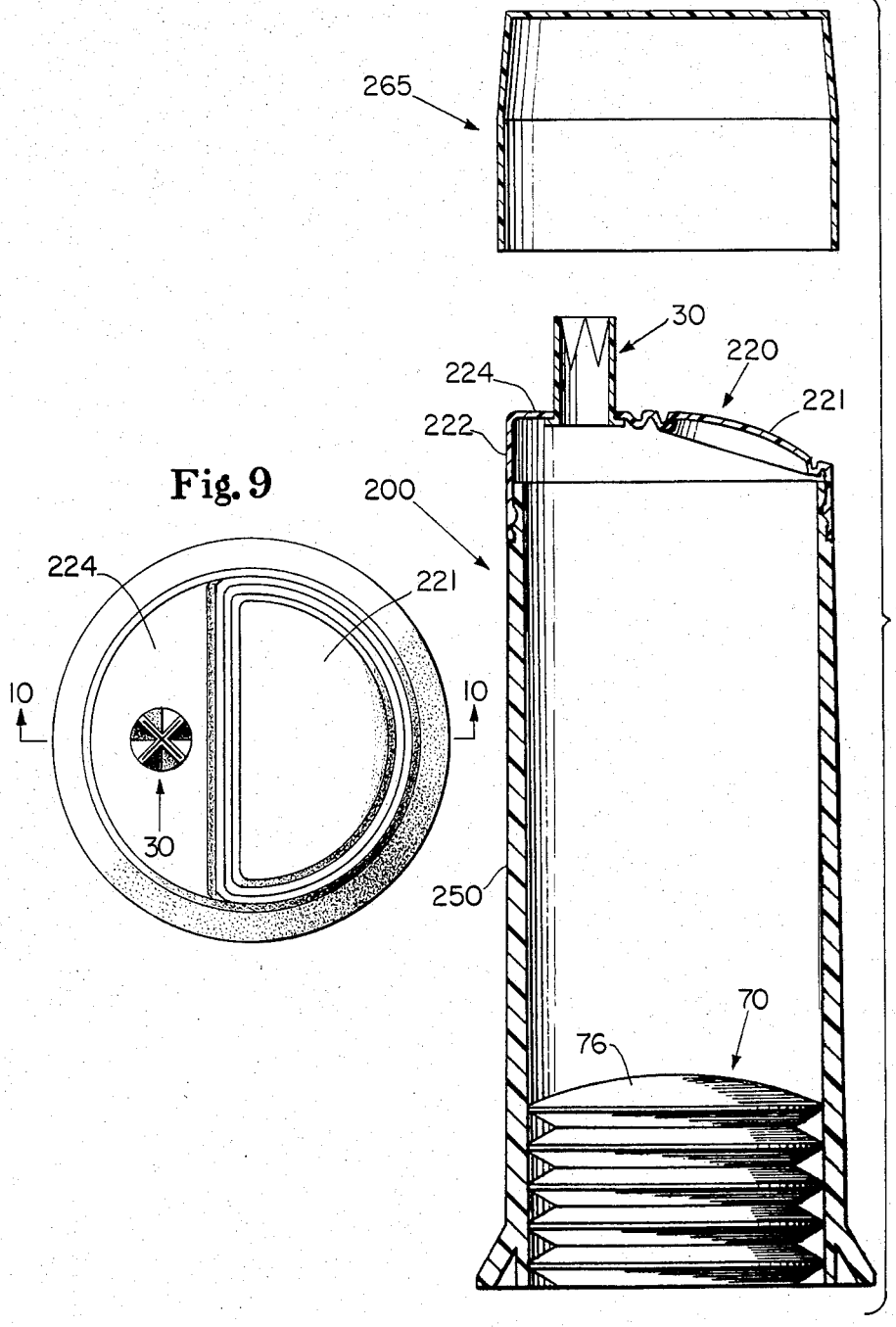
FIG. 9 is a top plan view of a fourth embodiment of a dispenser incorporating the follower device of the present invention.
FIG. 10 is a vertical cross-section view of the embodiment of FIG. 9, taken along line 10—10 thereof and including an overcap.

FIGS. 9 and 10 illustrate yet another equally preferred embodiment of the subject dispensing package. In the figures, dispensing package 200 is shown as including a resilient dispensing top 220 attached to the upper portions of container body 250. Resilient dispensing top 220 further includes a particularly defined pump actuation area or button portion 221 having a thickness and radius of curvature similar to those described with regard to rounded top section 21 above. Pump actuation area 221 is to feature sufficient resilience to permit its inward deflection for decreasing the volume within dispensing package 200 to dispense product through dispensing nozzle 30, and to return to its initial position following a dispensing operation thereby increasing the volume within package 200 and causing follower piston 70 to move upwardly therewithin as described above. As mentioned earlier, any of the pistons of the subject invention can be readily substituted in the various dispenser embodiments described herein.

It has been found that utilization of a more defined pump actuation area, such as button portion 221, facilitates the designing of a pump dispensing package to provide a more uniform and accurate dose of product during each dispensing operation. By confining the point or area of actuation on dispensing tops (e.g. 220), dispensing volume, as well as required dispensing force, can be more precisely controlled by design. This added control helps to make use of such dispensing tops more understandable and convenient to consumers, and thereby prevents misuse thereof. Resilient dispensing top 220 includes a substantially flat area 224 to which the self-sealing dispensing nozzle 30 is attached, and a peripheral skirt 222. It is preferred that the flat surface 224 and peripheral skirt 222 remain substantially rigid during dispensing operations, with only pump actuation area 221 being significantly deformed to provide dispensing pressure.

Dispensing nozzle 30 is oriented in a vertical direction substantially parallel to the central axis of container body 250, and an overcap 265 may be telescoped over the upper portions of container body 250 to enclose resilient dispensing top 220 and its self-sealing dispensing nozzle 30 for shipping, storage and handling.

Figure 11:
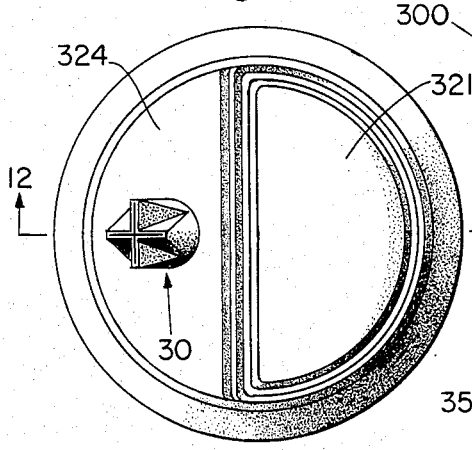
FIG. 11 is a top plan view of a fifth embodiment of a dispenser incorporating the follower device of the present invention.
Figure 12:
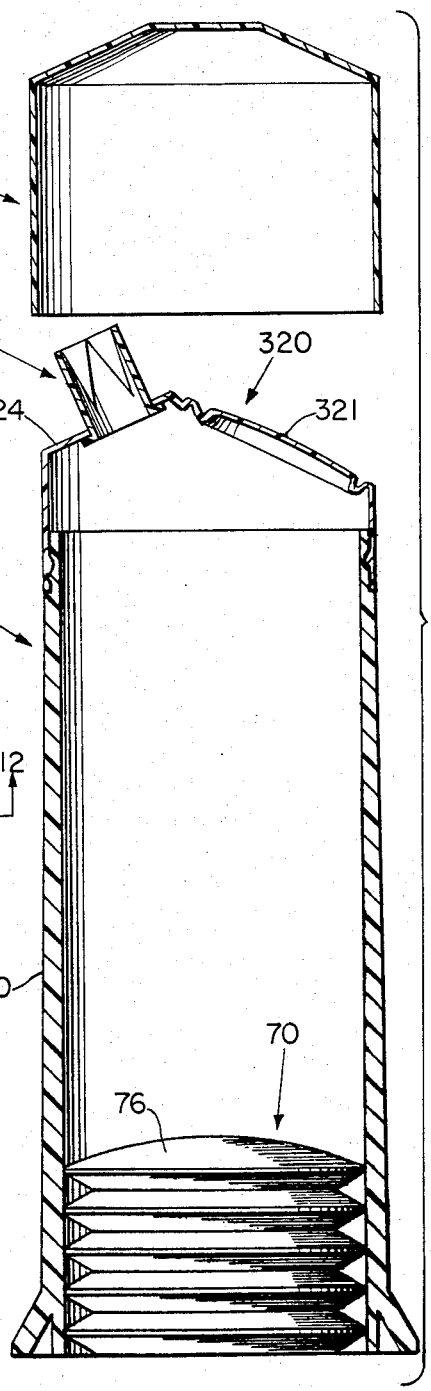
FIG. 12 is a vertical cross-section view of the embodiment of FIG. 11, taken along line 12—12 thereof and including an overcap.

FIGS. 11 and 12 illustrate an alternate embodiment similar to that shown in FIGS. 9 and 10; however, dispensing package 300 features a resilient dispenser top 320 having a substantially flat nozzle attachment surface 324 which is obliquely oriented thereby similarly orienting the self-sealing dispensing nozzle 30 at an outward angle from a line parallel to the central axis of container body 350. Again, resilient dispenser top 320 includes a pump actuation area or button surface 321 which has an outwardly rounded surface and defines a volume displacement or button surface for actuation of product dispensing. The angle at which dispensing nozzle 30 is oriented can be varied as desired for particular applications. An overcap 365 may be telescoped over the upper portions of dispensing package 300 thereby enclosing resilient dispenser top 320 and its attached self-sealing dispensing nozzle 30. As described above in relation to other embodiments of the present invention, the manner of attachment of the resilient dispensing top 320 and/or overcap 365 may be accomplished by any appropriate means such as snap fitments, threads, etc. The size and slope of flat surface 324 will obviously vary depending on orientation angles desired, nozzle diameters, desired area of pump actuation area 321, height of dispensing nozzle 30, and the like. Again, it is preferred that dispensing nozzle 30 not extend outwardly beyond the peripheral dimensions of container body 350 so that overcap 365 can be placed thereover without substantial interference.

Figure 13:
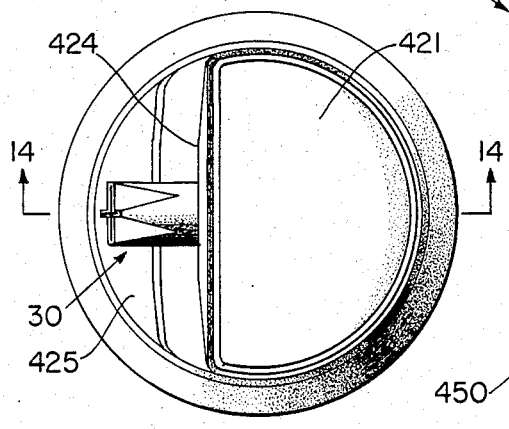
FIG. 13 is a top plan view of a sixth embodiment of a dispenser incorporating the follower device of the present invention.
Figure 14:
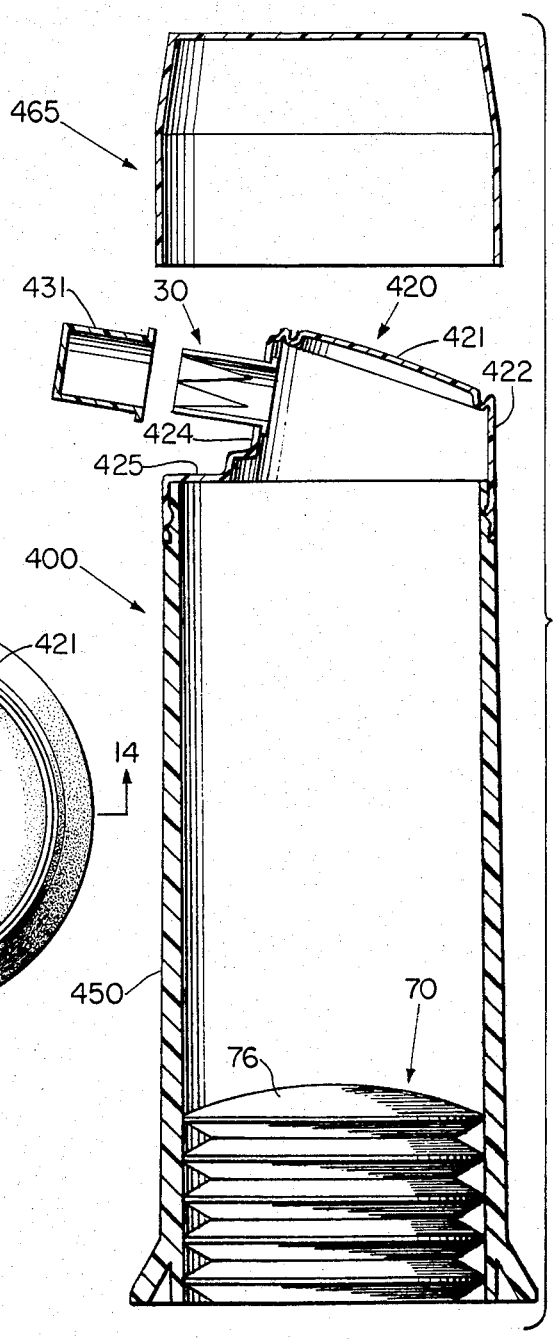
FIG. 14 is a vertical cross-section view of the embodiment of FIG. 13, taken along line 14—14 thereof and including an overcap.

Dispensing package 400 is illustrated in FIGS. 13 and 14 as including a resilient dispensing top 420 having a substantially vertical flat surface 424 to which a self-sealing dispensing nozzle 30 is attached in a substantially horizontal orientation thereon. Similar to the embodiments shown in FIGS. 10 and 12, resilient top portion 420 includes a defined pump actuation area 421 and a downwardly extending peripheral skirt 422. Dispensing nozzle 30 is shown as being mounted on vertical wall 424 such that it extends outwardly in a direction substantially normal to the central axis of tubular container body 450, with such dispensing nozzle 30 preferably not extending beyond the outer periphery thereof. A substantially flat area 425 connects vertical wall 424 to the peripheral top 420. Similar to the embodiments described above, an overcap 465 can be telescoped over the upper portions of tubular container body 450 thereby enclosing dispensing top 420 and its horizontal dispensing nozzle 30. Additionally, an inner nozzle cap 431 is illustrated as an auxiliary means to seal dispensing package 400. Similar nozzle caps could equally be utilized in conjunction with the other dispensing packages shown and described herein, whether or not an overcap is also included. Such nozzle caps also help protect nozzle 30 during shipping, handling, and storage.

The operation of dispensing packages 200, 300, and 400, respectively, is substantially identical to that described above with regard to dispensing package 10. While it is preferred that these resilient dispensing tops (e.g., 220, 320, and 420) be constructed as unitary elements having a dispensing nozzle 30 attached thereto, it is also contemplated that a multi-piece pumping mechanism (e.g., possibly including a spring-loaded pump actuator piston and the like such as described in the above-referenced U.S. Pat. No. Re 31,408) could equally be utilized in conjunction with any desired dispensing outlet and/or outlet system. It is also contemplated that dispensers having outlet nozzles extending beyond the outer periphery of the dispenser container body, or articulated or retractable dispensing outlet devices, could also equally be utilized in conjunction with the subject invention.

Various modifications and uses of the described invention in addition to those discussed above will be apparent to those skilled in the art. Accordingly, the scope of the present invention should be considered in terms of the following claims and is understood not to be limited to the details of structure and operation described and shown in the specification and drawings.

I claim:

1. An improved dispenser for a product, wherein the product is housed in an axially extending bore of a tubular container body having an upper end from which product is dispensed and an open lower end, said dispenser comprising a follower piston slidably mounted within said lower end of the bore of said body to support said product thereabove, said piston being constructed of resilient material and comprising a face portion adapted to contact the product and a peripherally attached sidewall which has at least one integral peripheral contact band conforming to the shape of the cross section of said bore, said sidewall being adapted to virtually resiliently longitudinally extend or contract in response to axial forces exerted on said face portion with such change in length resulting in an inversely proportional virtual change in lateral dimension of said peripheral contact band, said piston being hollow with the interior surfaces of said face and said sidewall exposed to atmospheric pressure, and said contact band dimensioned to provide an interference fit within the bore which exerts a predetermined normal force against the inner surfaces of said bore in static condition, whereby application of downward axial force on said piston face tends to virtually expand the lateral dimension of said peripheral contact band thereby increasing said normal force and proportionally increasing piston resistance to rearward displacement within said dispenser, and application of upward axial force on said piston face tends to virtually decrease the lateral dimension of said peripheral contact band thereby reducing said normal force and proportionally reducing piston resistance to upward displacement therein and permitting said follower piston to move upwardly within said dispenser while maintaining a seal with the inner surfaces of said bore.

2. The dispenser of claim 1, wherein said follower piston sidewall further comprises at least one thin-walled, reentrant, bellows-like concavity formed thereabout.

3. An improved dispenser for a product, wherein the product is housed in an axially extending bore of a tubular container body having an upper end from which product is dispensed and an open lower end, said dispenser comprising a follower piston slidably mounted within said lower end of the bore of said body to support said product thereabove, said piston being constructed of resilient material and comprising a face portion adapted to contact the product, a depending friction ring which establishes a predetermined frictional resistance to displacement of said piston within said bore in static condition, and a peripherally attached sidewall which has at least one integral peripheral contact band conforming to the shape of the cross section of said bore, said contact band dimensioned to provide an interference fit within the bore which exerts a predetermined normal force against the inner surfaces of said bore in static condition, said piston sidewall being adapted to virtually resiliently longitudinally extend or contract in response to axial forces exerted on said face portion with such change in length resulting in an inversely proportional virtual change in lateral dimension of said peripheral contact band and having at least one thin-walled, reentrant, bellows-like concavity formed thereabout, said bellows-like concavity further comprising an outwardly convex continuous depending sidewall, said depending sidewall being attached about its upper periphery to said face portion and about its lower periphery to said friction ring and having said peripheral contact band formed intermediate said face portion and said friction ring, and said piston being hollow with the interior surfaces of said face and said piston sidewall exposed to atmospheric pressure, whereby application of downward axial force on said piston face tends to virtually expand the lateral dimension of said peripheral contact band thereby increasing said normal force and proportionally increasing piston resistance to rearward displacement within said dispenser, and application of upward axial force on said piston face tends to virtually decrease the lateral dimension of said peripheral contact band thereby reducing said normal force and proportionally reducing piston resistance to upward displacement therein and permitting said follower piston to move upwardly within said dispenser while maintaining a seal with the inner surfaces of said bore.

4. The dispenser of claim 3, wherein said contact band of said follower piston is located at the radially largest continuous outside dimension of said outwardly convex sidewall.

5. An improved dispenser for a product, wherein the product is housed in an axially extending bore of a tubular container body having an upper end from which product is dispensed and an open lower end, said dispenser comprising a follower piston slidably mounted within said lower end of the bore of said body to support said product thereabove, said piston being constructed of resilient material and comprising a face portion adapted to contact the product and a peripherally attached sidewall, the interior surfaces of said face and said sidewall being exposed to ambient air, said sidewall being formed with at least one thin-walled, reentrant, bellows-like concavity thereabout, the upper and lower extremes of said concavity each being connected to an integral peripheral contact band conforming to the shape of the cross section of the bore, said sidewall being adapted to virtually resiliently longitudinally extend or contract in response to axial forces exerted on said face portion with such change in length resulting in an inversely proportional virtual change in lateral dimension of said peripheral contact bands, said contact bands being dimensioned to provide an interference fit within the bore which exerts a predetermined normal force against the inner surfaces of said bore in static condition, whereby application of downward axial force on said piston face tends to virtually expand the lateral dimensions of said peripheral contact bands thereby increasing said normal force and proportionally increasing piston resistance to rearward displacement within said dispenser, and application of upward axial force on said piston face tends to virtually decrease the lateral dimensions of said peripheral contact bands thereby reducing said normal force and proportionally reducing piston resistance to upward displacement therein and permitting said follower to move upwardly within said dispenser while maintaining a seal with the inner surfaces of said bore.

6. The dispenser of claim 5, wherein said follower piston sidewall is formed with a plurality of said thin-walled, reentrant, bellows-like concavities integrally connected in seriatim by peripheral contact bands at their upper and lower extremes thereby forming a thin-walled accordion-like structure which resiliently permits said depending sidewall to be virtually longitudinally strained by axial forces, said virtual longitudinal strain resulting in inversely proportional virtual radial dimensional strain of said peripheral contact bands.

7. The dispenser of claim 6 wherein said face portion of said follower piston is connected about its outer periphery to the upper extreme of the uppermost bellows-like concavity by the uppermost integral peripheral contact band.

8. The dispenser of claims 4, 6 or 7 wherein the product-contacting side of said face portion of said follower piston is substantially convex.

9. The dispenser of claims 4, 6 or 7 wherein the product-contacting side of said face portion of said follower piston is substantially concave.

10. The dispenser of claims 4, 6 or 7 wherein the product-contacting side of said face portion of said follower piston is substantially flat.

11. The dispenser of claim 6, wherein said reentrant, bellows-like concavities have included angles of between about 30° and about 120°.

12. The dispenser of claim 11, wherein said reentrant, bellows-like concavities each have a pitch of at least about 3.2 mm (0.125 inches).

13. An improved dispenser for a product, wherein the product is housed in an axially extending bore of a tubular container. body having an upper end from which product is dispensed and an open lower end, said dispenser comprising a follower piston slidably mounted within said lower end of the bore of said body to support said product thereabove, said piston being constructed of resilient material and comprising a face portion adapted to contact the product, a friction ring dimensioned to provide an interference fit within said bore which exerts a predetermined normal force against the inner surfaces of said bore in static condition, and a peripherally attached sidewall further comprising at least two oppositely disposed helical strips depending from the lower periphery of said face portion and attached at their lower ends to the upper periphery of said friction ring, said helical strips conforming to the shape of the cross section of said bore thereby establishing at least two peripheral contact bands, said sidewall being adapted to virtually resiliently longitudinally extend or contract in response to axial forces exerted on said face portion with such change in length resulting in an inversely proportional virtual change in lateral dimension of said peripheral contact bands, said piston being hollow with the interior surfaces of said face and said sidewall exposed to atmospheric pressure.

14. The dispenser of claim 13, wherein said follower piston further comprises two right-handed and two left-handed helical strips depending from the lower periphery of said face portion and attached at their lower ends to the upper periphery of said friction ring, each of said helical strips formed as one full helical revolution, said helical strips being connected to one another at their helical intersections thereby forming a perforated sidewall.

15. An improved pump-type dispenser for a fluid product, wherein the product is housed in an axially extending bore of a tubular container body having an upper end which communicates with a discharge passageway and an open lower end, said dispenser comprising a follower piston slidably mounted within the bore of said body and sealing the same against escape of product from said lower end, said piston being constructed of resilient material and comprising a face portion adapted to contact the product and a peripherally attached sidewall, said sidewall further comprising at least one integral peripheral contact band conforming to the shape of the cross section of said bore and being adapted to virtually resiliently longitudinally extend or contract in response to axial forces exerted on said face portion with such change in length resulting in inversely proportional virtual change in lateral dimension of said peripheral contact band, said piston being hollow and the interior surfaces of said face and side sidewall being exposed to atmospheric pressure, said contact band being dimensioned to provide an interference fit within the bore which exerts a predetermined force against the inner surfaces of said bore in static condition, whereby application of pumping pressure to said product tends to virtually expand the lateral dimension of said peripheral contact band thereby increasing said normal force to prevent movement of said piston toward the open end of the bore and reduction of pressure within the product to below atmospheric tends to virtually decrease the lateral dimension of said peripheral contact band thereby reducing said normal force and permitting ambient air pressure to move said piston toward the upper end of the bore until equilibrium is reached, said piston maintaining its seal within said bore as it moves upwardly therewithin.

16. The dispenser of claim 15, wherein said follower piston sidewall further comprises at least one thin-walled, reentrant, bellows-like concavity formed thereabout.

17. The dispenser of claim 15, wherein said follower piston further comprises a depending friction ring dimensioned to provide an interference fit within said bore which exerts a predetermined normal force against the inner surfaces of said bore in static condition, and wherein said sidewall further comprises at least two oppositely disposed helical strips depending from the lower periphery of said face portion and attached at their lower ends to the upper periphery of said friction ring, said helical strips conforming to the shape of the cross section of said bore thereby establishing at least two peripheral contact bands.

18. A pump-type dispenser for a fluid product, wherein the product is housed in an axially extending bore of a tubular container body having an upper end which communicates with a discharge passageway and an open lower end, said dispenser comprising a follower piston slidably mounted within the bore of said body and sealing the same against escape of product from said lower end, said piston being constructed of resilient material and comprising a face portion adapted to contact the product, a depending friction ring which establishes a predetermined frictional resistance to displacement of said piston within said bore in static condition, and a peripherally attached sidewall further comprising at least one integral peripheral contact band conforming to the shape of the cross section of said bore and having at least one thin-walled, reentrant, bellows-like concavity formed thereabout, said piston sidewall being adapted to virtually resiliently longitudinally extend or contract in response to axial forces exerted on said face portion with such change in length resulting in inversely proportional virtual change in lateral dimension of said peripheral contact band, said piston being hollow and the interior surfaces of said face and said piston sidewall being exposed to atmospheric pressure, said bellows-like concavity further comprising an outwardly convex continuous depending sidewall, said depending sidewall being attached about its upper periphery to said face portion and about its lower periphery to said friction ring and having said peripheral contact band formed intermediate said face portion and said friction ring, said contact band being dimensioned to provide an interference fit within the bore which exerts a predetermined normal force against the inner surfaces of said bore in static condition, whereby application of pumping pressure to said product increases said normal force to prevent movement of said piston toward the open end of the bore and reduction of pressure within the product to below atmospheric reduces said normal force and permits ambient air pressure to move said piston toward the upper end of the bore until equilibrium is reached, said piston maintaining its seal within said bore as it moves upwardly therewithin.

19. An improved pump-type dispenser for a fluid product, wherein the product is housed in an axially extending bore of a tubular container body having an upper end which communicates with a discharge passageway and an open lower end, said dispenser comprising a follower piston slidably mounted within the bore of said body and sealing the same against escape of product from said lower end, said piston being constructed of resilient material and comprising a face portion adapted to contact the product and a peripherally attached sidewall, said piston being hollow and the interior surfaces of said face and said sidewall being exposed to ambient air, said sidewall being formed with at least one thin-walled, reentrant, bellows-like concavity thereabout, the upper and lower extremes of said concavity each being connected to an integral peripheral contact band conforming to the shape of the cross section of the bore, said contact bands being dimensioned to provide an interference fit within the bore which exerts a predetermined normal force against the inner surfaces of said bore in static condition, whereby application of pumping pressure to said product tends to virtually expand the lateral dimensions of said peripheral contact bands thereby increasing said normal force to prevent movement of said piston toward the open end of the bore and reduction of pressure within the product to below atmospheric tends to virtually decrease the lateral dimensions of said peripheral contact bands thereby reducing said normal force and permitting ambient air pressure to move said piston toward the upper end of the bore until equilibrium is reached, said piston maintaining its seal within said bore as it moves upwardly therewithin.

20. The dispenser of claim 19, wherein the peripherally attached sidewall of said follower piston is formed with a plurality of said thin-walled, reentrant, bellows-like concavities integrally connected by said contact bands at their upper and lower extremes thereby forming a thin-walled accordion-like structure which resiliently permits said sidewall to be virtually longitudinally strained by said pumping pressure, said virtual longitudinal strain resulting in inversely proportional virtual lateral dimension strain of said peripheral contact bands, whereby virtual lateral expansion of said contact bands results in increased normal force exerted by said contact bands against the inner surfaces of said bore, and virtual lateral compression of said contact bands results in decreased normal force exerted thereby.

21. The dispenser of claim 20 wherein the product-contacting side of said face portion of said follower piston is substantially convex.

22. The dispenser of claim 20 wherein the product-contacting side of said face portion of said follower piston is substantially concave.

23. The dispenser of claim 20 wherein the product-contacting side of said face portion of said follower piston is substantially flat.

24. The dispenser of claim 21 wherein the face portion of said follower piston is connected about its outer periphery to the upper extreme of the uppermost bellows-like concavity by the uppermost integral peripheral contact band.

25. The dispenser of claim 20 wherein said reentrant, bellows-like concavities have included angles of between about 30° and about 120°.

26. The dispenser of claim 25, wherein said reentrant, bellows-like concavities each have a pitch of at least about 3.2 mm (0.125 inches).

27. An improved pump-type dispenser for a fluid product, wherein the product is housed in an axially extending bore of a tubular container body having an upper end including a resilient dispensing top having a defined pump actuation area and a dispensing outlet formed therethrough, and an open lower end, said dispenser comprising a follower piston slidably mounted within the bore of said container body and sealing the same against escape of product from said lower end, said piston being constructed of resilient material and comprising a face portion adapted to contact the product and a peripherally attached sidewall, said piston being hollow and the interior surfaces of said face and said sidewall being exposed to ambient air, said sidewall being formed with at least one thin-walled, reentrant, bellows-like concavity thereabout, the upper and lower extremes of said concavity each being connected to an integral peripheral contact band conforming to the shape of the cross section of the bore, said contact bands being dimensioned to provide an interference fit within the bore which exerts a predetermined normal force against the inner surfaces of said bore in static condition, whereby application of pumping pressure to said product increases said normal force to prevent movement of said piston toward the open end of the bore and reduction of pressure within the product to below atmospheric reduces said normal force and permits ambient air pressure to move said piston toward the upper end of the bore until equilibrium is reached, said piston maintaining its seal within said bore as it moves upwardly therewithin.

28. The pump-type dispenser of claim 27, wherein said dispensing outlet comprises a one-way outlet check valve attached to said resilient dispensing top.

29. The pump-type dispenser of claim 28, wherein said outlet check valve is oriented in a vertical direction substantially parallel to the central axis of said tubular container body.

30. The pump-type dispenser of claim 28, wherein said outlet check value is oriented in a horizontal direction substantially normal to the central axis of said tubular container body.

31. The pump-type dispenser of claim 28, wherein said outlet check valve is oriented at an oblique direction relative the central axis of said tubular container body.

32. The pump-type dispenser of claim 29, 30, or 31, wherein said outlet check valve is mounted on said resilient dispensing top and does not extend outwardly beyond the outer periphery of said tubular container body.

33. The pump-type dispenser of claim 32, wherein said dispenser includes an overcap which telescopes over the upper end of said dispenser to cover said resilient dispensing top and its outlet check valve.

* * * * *